United States Patent [19]

Peterson

[11] Patent Number: 4,605,338

[45] Date of Patent: Aug. 12, 1986

[54] CULVERT

[76] Inventor: Carl W. Peterson, 200, 7603-104 Street, Edmonton, Alberta, Canada

[21] Appl. No.: 612,819

[22] Filed: May 22, 1984

[30] Foreign Application Priority Data

May 31, 1983 [CA] Canada ..... 429322

[51] Int. Cl.[4] ..... E01F 5/00

[52] U.S. Cl. ..... 405/124; 405/157

[58] Field of Search ..... 405/124–126, 405/132, 134, 157; 138/105, 110, 121, 157, 159, 172, 173; 52/86, 89

[56] References Cited

U.S. PATENT DOCUMENTS

| | | | |
|---|---|---|---|
| 1,228,662 | 6/1917 | Good | 405/125 |
| 2,674,857 | 4/1954 | Fortes | 138/172 X |
| 3,131,541 | 5/1964 | Guthrie | 138/110 X |
| 3,508,406 | 4/1970 | Fisher | 405/124 |
| 3,735,595 | 5/1973 | Watkins | 405/124 |
| 4,211,504 | 7/1980 | Sivachenko | 405/124 X |
| 4,390,306 | 6/1983 | Fisher | 405/124 |

FOREIGN PATENT DOCUMENTS

| | | | |
|---|---|---|---|
| 1143170 | 3/1983 | Canada | 405/124 |

*Primary Examiner*—Cornelius J. Husar
*Assistant Examiner*—Nancy J. Stodola
*Attorney, Agent, or Firm*—Harold H. Dutton, Jr.; George H. Dunsmuir

[57] ABSTRACT

An arch-culvert structure for use in the construction of culverts or the like, includes a corrugated metal conduit and corrugated metal or concrete wings extending outwardly from the top sides of the conduit for distributing the soil or live load. Such structure is relatively inexpensive and increases the resistance to failure in the roof portion of the structure, in the wall area and in the soil or backfill materials adjacent to the structure.

10 Claims, 15 Drawing Figures

CULVERT

BACKGROUND OF THE INVENTION

This invention relates to an arch-culvert structure and in particular to an arch-beam for use in the construction of culverts.

Applicant's prior Canadian Pat. No: 1,143,170 issued on Mar. 22, 1983 discloses an arch-beam structure for use in culverts, including a concrete panel which extends across the top surface and beyond the side edges of the conduit portion of the culvert for distributing the forces acting on the top of the culvert. The arch-beam structure of applicant's earlier patent is effective in relatively shallow site situations with little overburden for distributing any overburden load. Continuing developments by the inventor have produced a somewhat simpler, less expensive version of the arch-beam structure disclosed by the above identified patent and one which can be utilized at greater depths i.e. increased weight of overburden. Applicant has not been able to find arch-beam structure similar to the new structure in the patent art. To applicant's knowledge the closest prior art is Canadian Pat. No: 804,292 which issued to Armco Steel Corporation on Jan. 21, 1969 and U.S. Pat. Nos: 3,131,541 issued to J. E. Guthrie on May 5, 1964 and U.S. Pat. No. 3,508,406 issued to C. L. Fisher on Apr. 28, 1970. In general the structure disclosed by the prior art does not distribute the overburden load and other applied loads effectively.

The object of the present invention is to provide a relatively simple, strong arch-beam structure.

BRIEF SUMMARY OF THE INVENTION

Accordingly the present invention relates to an arch-culvert structure for use in a culvert of the type including an elongated conduit having top, bottom and side surfaces, the arch-beam structure comprising a concrete or metal wing extending outwardly a substantial distance from each side of the conduit at the junction between the top and a side surface for distributing downward forces acting on the culvert outwardly when in use; and fastening means connecting said wing to said side surface of the conduit.

The present invention generally does not operate in the same manner as does the structure described in applicant's earlier patent. In general the present invention is not intended to and does not provide the same amounts of confining pressure in the backfill areas adjacent to the structure, as the structure of the earlier patent. The structure of the present invention does develop some more modest levels of confining pressures in the backfill area, but these are not sufficient to constitute a main feature of the operation of the present structure. The present invention is intended to develop enhanced axial reaction forces which are provided by the wings, which cause little bending in the roof of the culvert, which aid in resisting the arching forces produced by action of the dead and live loads on the roof, and which result in outwardly acting resultant forces at the ends of the roof i.e. at the junction of the wings with the roof. The wings have relatively large top and bottom surface areas for engaging the adjacent backfill/soil material, principally by friction, the frictional forces being developed between such surface areas and the overlying and underlying backfill materials contacting them.

The preferred backfill material is generally pressured into firm contact with the wing surfaces by the force of the accumulated weight of the overlying soil. The beam strength of the roof of the culvert using the structure of the present invention will generally be less than that for the roof of the structure disclosed in Canadian Pat. No: 1,143,170. Accordingly, with the structure of the present invention, the roof will not be able to provide, due to its bending strength, large vertical force components acting downward which provide the containing action for the backfill adjacent to the structure, as is the case with the structure of applicant's earlier patent. With the structure of the present invention the roof of the conduit acts principally in arching, the arching reactions being resisted by the wings and to a lesser extent by the walls of the conduit.

A distinct advantage of the present invention is to be found in the nature of the wings and their junction with and connection to the roof of the conduit. The reactive forces developed by the wings are transferred to the roof without causing significant bending moment effects in the roof, because the joints between the wings and the roof are effected within short lengths which can effectively be treated, for purposes of analysis, as pinned joints between such elements. Generally little or no consideration need be given to bending moments at the joints, at least insofar as they are caused by the wings, and little or no net bending effects are added to the roof by the wings.

BRIEF DESCRIPTION OF THE DRAWINGS

The invention will now be described in greater detail with reference to the accompanying drawings, which illustrate preferred embodiments of the invention and wherein.

DESCRIPTION OF THE PREFERRED EMBODIMENT(S)

Figure 2:
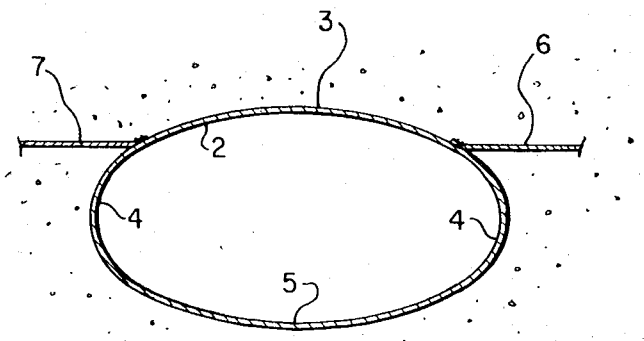
FIG. 2 is a cross-sectional view of the structure of FIG. 1.
Figure 3:
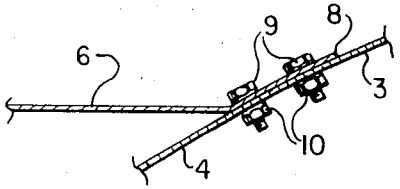
FIG. 3 is a cross-sectional view of the junction between the conduit and one wing of the structure of FIGS. 1 and 2.
Figure 1:
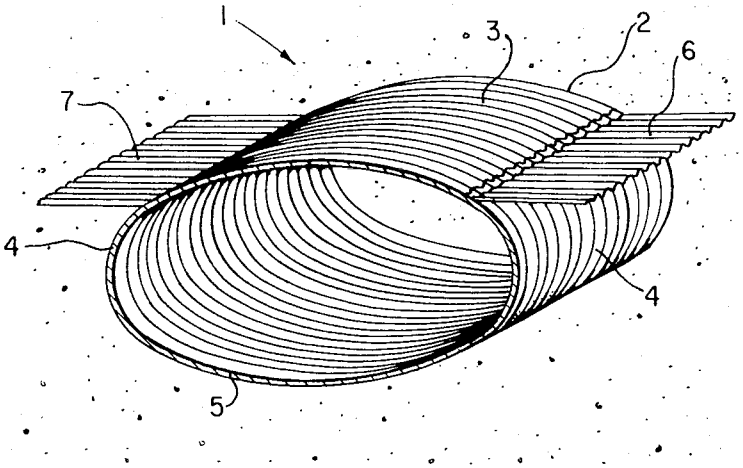
FIG. 1 is a schematic perspective view from above of a section of arch-culvert structure in accordance with the present invention.

With reference to FIGS. 1 to 3 of the drawings, the arch-culvert structure of the present invention is generally indicated at 1 and is intended for use with a conventional culvert of the type including a conduit 2. In the first embodiment of the invention the conduit 2 is elliptical, including a top 3, sides 4 and a bottom 5. The conduit 2 is formed of corrugated metal.

In the embodiment of the structure shown in FIGS. 1 to 3 the arch-culvert portion is defined by a pair of wings 6 and 7 which extend outwardly from the sides 4 of the conduit 2 for transferring such load of backfill material and other imposed loads such as may exist in the area of the junction between the top 3 and the sides 4 of the conduit, and which arise principally due to arching in the roof or top 3. The wings 6 and 7 are also formed of corrugated metal. The inner edge 8 of each wing 6 and 7 is bent to conform to the contour of the conduit 2. Such inner edge 8 of each wing 6 and 7 is secured to the conduit by a plurality of bolts 9 and 10 (FIG. 3).

In a second embodiment of the invention (FIGS. 4 and 5) the conduit is defined by a generally U-shaped trough, which forms a bottom 12 and sides 13 of the conduit, and by a top panel 14. The top panel 14 is bowed upwardly and is connected to the sides 13 of the conduit by connector strips 15 (FIG. 5) which are L-shaped in cross section. Each strip 15 is connected to one side wall 13 and the top wall 14 by bolts 17 and nuts 18. A wing 20 extends outwardly from each side of the conduit at the junction between the side wall 13 and the top panel 14. The wings 20 are connected to the strips 15 by bolts 21 and nuts 22. The wings 20 are, in effect, continuations of the top panel 14 and have the same curvature as such panel 14. It will be appreciated that the wings 20 perform the same function as the horizontally extending wings 6 and 7 of the structure of FIGS. 1 to 3.

Figure 5:
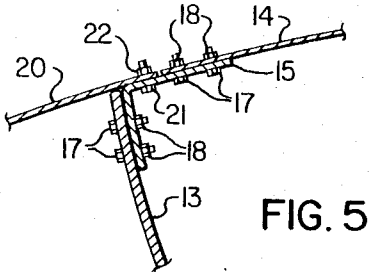
FIG. 5 is a cross-sectional view of the junction between the sides and top walls of the structure of FIG. 4.
Figure 6:
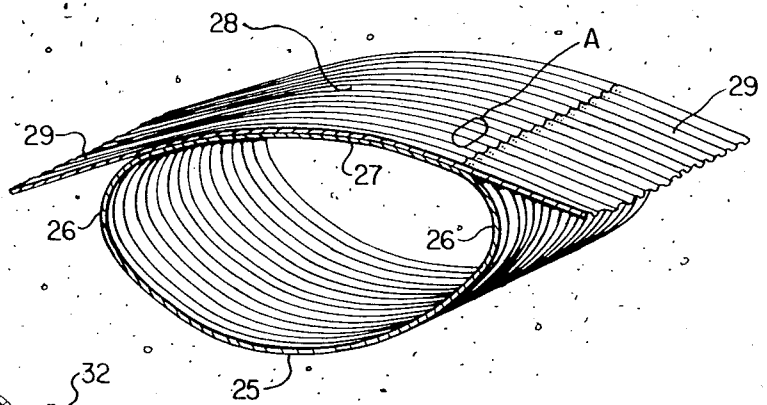
FIGURE 6 is a schematic perspective view from above of a section of a third embodiment of arch-culvert structure in accordance with the present invention.
Figure 4:
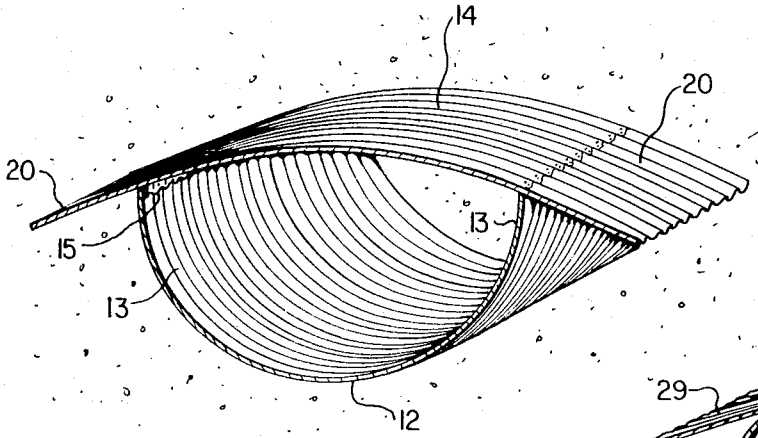
FIG. 4 is a schematic, perspective view from above of a section of a second embodiment of the arch-culvert structure of the present invention.
Figure 7:
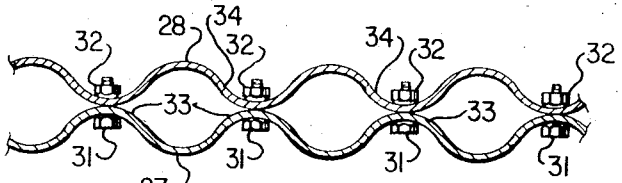
FIG. 7 is a longitudinal sectional view of the structure of FIG. 6 in the area A of FIG. 6.

The structure of FIGS. 6 and 7 is somewhat similar to that of FIGS. 4 and 5 except that the conduit is a generally elliptical body including a bottom wall 25 and integral side and top walls 26 and 27 respectively. A separate panel 28 covers the top wall 27 and wings 29 extend outwardly from each side of the panel 28. As shown in FIG. 7 the panel 28 and the wings 29 are connected to the top wall 27 by bolts 31 and nuts 32 so that the peaks 33 of the corrugated metal forming the conduit oppose the troughs 34 of the panel 28 and wings 29.

Figures 8, 9, 10, 11, 12:
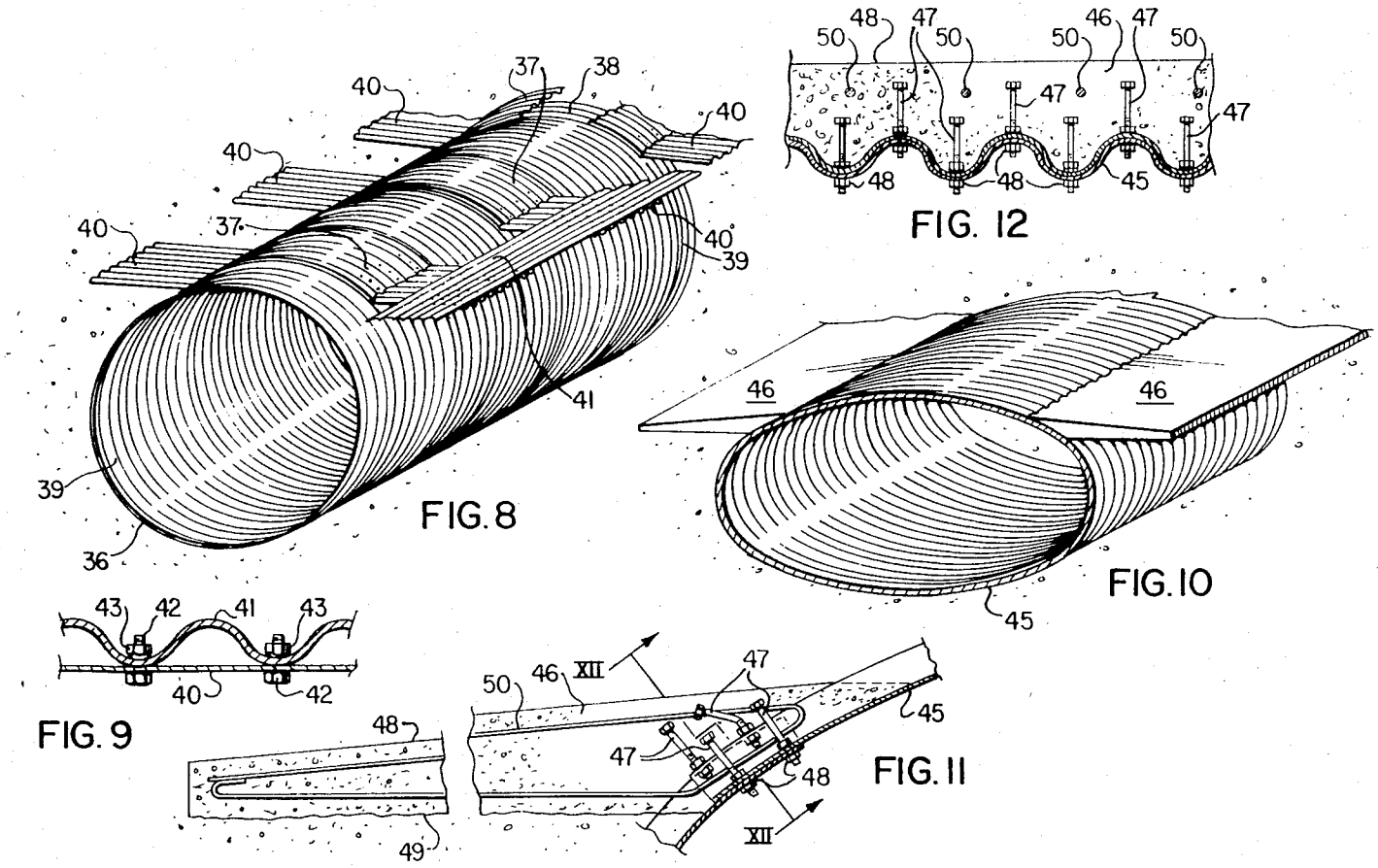
FIG. 8 is a schematic, perspective view from above of a section of a fourth embodiment of the arch-culvert structure in accordance with the present invention.
FIG. 9 is a cross-section of a portion of a wing of the structure of FIG. 8.
FIG. 10 is a schematic, perspective view from above of a fifth embodiment of the arch-culvert structure in accordance with the present invention.
FIG. 11 is a cross sectional view of one of the wings of the structure of FIG. 10.
FIG. 12 is a cross-section taken generally along line XII—XII of FIG. 11.

Referring to FIGS. 8 and 9 in a fourth embodiment of the the invention, a cylindrical conduit 36 is used. A plurality of arcuate panels 37 extend across the top 38 at the junction between the top 38 and the sides 39 of the conduit 36. The panels 37 are spaced apart along the length of the conduit 36. A pair of wings 40, which are integral with each panel or panels 37 extend horizontally outwardly from the conduit 36. While the wings 40 can be used alone, a longitudinally extending strip 41 of corrugated metal can be provided. The strip 41 extends horizontally between adjacent wings 40 for further distributing reactions due to overburden and other applied loads in the area of such wings by enhancing frictional resistance where required. The strip 41 is connected to the wings 40 by bolts 42 and nuts 43 (FIG. 9).

The fifth embodiment of the invention which is shown in FIGS. 10 to 12 includes an elliptical conduit 45 and a pair of reinforced concrete wings 46. The ends of the sheets of corrugated metal defining the conduit 45 are, in this example, inter-connected by bolts 47 and nuts 48. The bolts 47 extend outwardly from the conduit 45 into the wings 46 for connecting the wings to the conduit. If necessary some of the bolts 47 are bent so that all of the bolts are completely encased in the wings 46. The wings 46 may taper outwardly with inclined top surfaces 48 and horizontal bottom surfaces 49, or may have planar top and bottom surfaces, or both surfaces may be inclined. The wings 46 are shown re-inforced by a plurality of steel rods 50.

Figure 14:
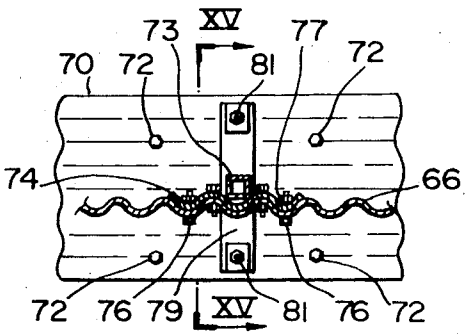
FIG. 14 is a cross-section taken generally along line XIV—XIV of FIG. 13.
Figure 13:
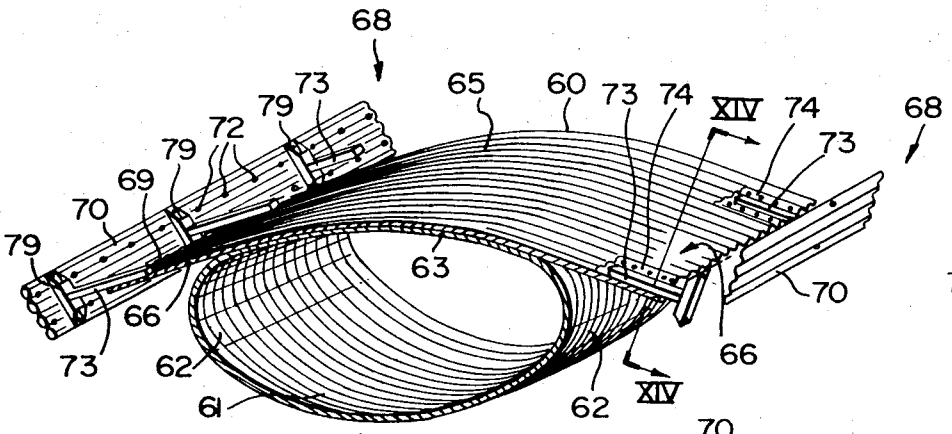
FIG. 13 is a perspective view from above and one end of a sixth embodiment of the arch-culvert structure of the present invention.
Figure 15:
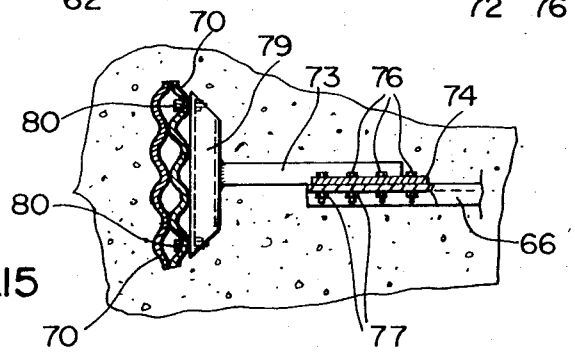
FIG. 15 is a cross-section taken generally along line XV—XV of FIG. 14.

Referring to FIGS. 13 to 15, the sixth embodiment of the invention is basically similar to that of FIG. 6 and is intended for use with a generally elliptical conduit 60. The conduit 60 is defined by integral bottom, side and top walls 61, 62 and 63 respectively. A separate arcuate panel 65 covers the top wall 63 with wings 66 extending outwardly from each side thereof.

A second wing generally indicated at 68 is provided beyond the outer free end 69 of each wing 66. The wings 68 are generally perpendicular to the outer ends of the wings 66. Each wing 68 is defined by a pair of rectangular corrugated metal panels 70 which are interconnected along their lengths by bolts and nuts 72. The panels 70 are connected together in such manner (FIG. 25) that the peaks of one panel oppose the troughs of the other panel.

The wings 68 are connected to the wings 66 by struts 73 and small rectangular, corrugated metal panels 74. The struts 73, which are tubular, rectangular elements are welded to the panels 74 and the panels 74 are connected to the wings 66 by bolts 76 and nuts 77. A hollow, rectangular cross section bar 79 is provided on the outer end of each strut 73 for connecting the latter to the wing 68. The crossbars 79 are connected to the wings 68 by bolts 80 and nuts 81.

It will be appreciated that while such a structure would not be as practical as the above described device the second wing 68 could be connected directly to the outer free end of the wing 66 without spacing therebetween.

In use the structure of FIGS. 13 to 15 is installed and backfill is placed around the wings 68. The space provided between the outer ends of the wings 66 and the wings 68 facilitates backfilling. Some portion of the roof reaction loads i.e. loads on the panel 65 is transferred to the wings 68. The wings 68 being vertically restrained by backfill serve to restrain vertical movement of the struts 73 and consequently maintain substantially axial loading conditions in the wing and strut. By axial loading is meant loadind in the direction of the longitudinal axes of the struts 73. The wings 68 also serve to distribute strut resistance loads evenly to the top of the arch-beam structure, thereby reducing the possibility of roof bending. This embodiment of the invention is useful in situations in which the area available for siting of a permanent structure are limited; where roof loads and corresponding thrust forces on the wings are exceptionally large and must be transferred to the backfill within a short distance of the structure; where the loads must be transferred to a specific area of the backfill or where the quantity of backfill must be kept to a minimum.

In general, it is preferable to assemble the arch-culvert structure on location i.e. at the location where the structure is to be used, the conduit is installed and backfill is placed around the conduit up to the wing level. The wings are then attached to the conduit on the backfill, which may be left in loose condition to a shallow depth below the wing height so that the wings can settle into the backfill. The material under the wings is vibrated or tamped to help seat the wings in the granular backfill material. Finally, backfill material is deposited on the culvert structure in the conventional manner.

The arch-culvert structures described hereinbefore can be used in the construction of new culverts or for strengthening existing structures.

I claim:

1. A culvert structure comprising an elongated conduit having top, bottom and side surfaces, said culvert structure comprising a pair of wing members being attached to opposite side surfaces of said conduit along a marginal edge of each of said wing members and extending laterally outwardly therefrom a substantial distance for distributing downward forces acting on the culvert outwardly from said conduit when in use, the attachment of each of said wing members to said conduit being so constructed that reactive forces developed by said wing members are transferred to the top of said conduit without causing significant bending moment effects in the top surface of said conduit.

2. An arch culvert structure according to claim 1 wherein said conduit is elliptical in cross section and each of said wing members includes a strip of corrugated metal connected to said conduit and extending horizontally outwardly in opposite directions therefrom when in use.

3. An arch-culvert structure according to claim 1 including a substantially Y-shaped element defining the bottom and sides of said conduit and an upwardly bowed panel defining the top of said conduit, each said wing members being connected to one said side and said top of said conduit.

4. An arch-beam structure according to claim 3 including an elongated connector strip of generally L-shaped configuration for inter connecting said top and side of said conduit and said wing means.

5. An arch-culvert structure according to claim 1 including an arcuate panel extending across the top surface of said conduit, said wing member extending outwardly from one side edge of said panel.

6. An arch-culvert structure according to claim 5 including a plurality of spaced apart arcuate panels extending across the top surface of said conduit, each said wing member being connected to one side edge of said panel.

7. An arch-culvert structure according to claim 6 including an elongated re-inforcing strip extending between and interconnecting a plurality of wing members remote from said conduit.

8. An arch-culvert structure according to claim 1 wherein each said wing members is defined by an elongated strip of re-inforced concrete extending substantially horizontally outwardly beyond the side of said conduit.

9. An arch culvert structure for use in a culvert of the type including an elongated conduit having top, bottom and side surfaces, the arch culvert structure comprising first wing members extending outwardly in opposite directions a substantial distance from each side of the conduit at the junction between the top and a side surface for distributing downward forces and acting on the culvert when in use; fastener members connecting each said wing to said side surface of the conduit along a marginal edge of each said wing member; second wing members connected to the outer free end of said first wing members, said second wing members being substantially perpendicular to said first wing members for counteracting forces acting on the top of the culvert during use.

10. An arch culvert structure according to claim 9 including strut means connecting said second wing members to said first wing members, whereby said second wing member is spaced apart from said first wing member for facilitating backfilling around the culvert.

* * * * *